US009185932B2

(12) United States Patent
Dekkers et al.

(10) Patent No.: US 9,185,932 B2
(45) Date of Patent: Nov. 17, 2015

(54) TOBACCO DOSING SYSTEM

(75) Inventors: Ronald Petrus Gerhardus Dekkers, Hasselt (NL); Mark Leendert Meijer, Zwolle (NL)

(73) Assignee: Sluis Cigar Machinery B.V., Kampen (NL)

( * ) Notice: Subject to any disclaimer, the term of this patent is extended or adjusted under 35 U.S.C. 154(b) by 0 days.

(21) Appl. No.: 14/115,908

(22) PCT Filed: May 14, 2012

(86) PCT No.: PCT/NL2012/050335

§ 371 (c)(1),
(2), (4) Date: Jan. 21, 2014

(87) PCT Pub. No.: WO2012/158029

PCT Pub. Date: Nov. 22, 2012

(65) Prior Publication Data

US 2014/0150808 A1 Jun. 5, 2014

(30) Foreign Application Priority Data

May 16, 2011 (NL) ..... 2006784

(51) Int. Cl.
*A24C 1/02* (2006.01)
*A24C 5/39* (2006.01)

(52) U.S. Cl.
CPC ... *A24C 1/02* (2013.01); *A24C 5/39* (2013.01); *A24C 5/392* (2013.01); *A24C 5/397* (2013.01)

(58) Field of Classification Search
CPC ..... A24C 5/39; A24C 5/392; A24C 5/397; A24C 1/02
USPC ..... 406/30–33; 131/108–110
See application file for complete search history.

(56) References Cited

U.S. PATENT DOCUMENTS 3,580,644 A * 5/1971 Ballard ..... 406/30
2010/0200083 A1* 8/2010 Kouchi et al. ..... 137/486

FOREIGN PATENT DOCUMENTS

DE 2655036 A1 6/1978
FR 748307 A 7/1933

OTHER PUBLICATIONS

Engineering Toolbox, Types of Flowmeters, Mar. 21, 2008 (downloaded online Dec. 15, 2014 from archive.org].*
Machine Translation of DE 2655036 A1.
Machine Translation of FR 748307 A.

* cited by examiner

*Primary Examiner* — Anthony Calandra
(74) *Attorney, Agent, or Firm* — Hoffmann & Baron, LLP

(57) ABSTRACT

A tobacco dosing system (1) for providing doses of tobacco (4) includes a tobacco supply (3) constructed and arranged to supply tobacco (4), a dosing device (5) including at least one dosing cup (11, 12) for receiving the tobacco (4) to be dosed, a gas flow device (6) constructed and arranged to in use provide a gas flow (10) through the tobacco received by the at least one dosing cup (11, 12), a gas flow measuring (7) device constructed and arranged to measure a property of the gas flow (10), and a controlling device (8) operably connected to the dosing device (5) and the gas flow measuring device (7) to control the operation of the tobacco dosing system (1) on basis of the measured property.

20 Claims, 6 Drawing Sheets

TOBACCO DOSING SYSTEM

CROSS-REFERENCE TO RELATED APPLICATIONS

This application is the National Stage of International Application No. PCT/NL2012/050335, filed May 14, 2012, which claims the benefit of Netherlands Application No. 2006784, filed May 16, 2011, the contents of which is incorporated by reference herein.

FIELD OF THE INVENTION

This disclosure relates to a tobacco dosing system for providing doses of tobacco. The tobacco dosing system is used to produce doses of tobacco which in practice often are delivered to a transportation system to transport the tobacco to systems, such as packaging systems, to further process the tobacco doses.

SUMMARY OF THE INVENTION

The tobacco dosing system comprises a tobacco supply constructed and arranged to supply tobacco, a dosing device comprising at least one dosing cup for receiving the tobacco to be dosed, a gas flow device constructed and arranged to in use provide a gas flow through the tobacco received by the at least one dosing cup.

BRIEF DESCRIPTION OF THE DRAWINGS

Embodiments of a tobacco dosing system will be described by way of example only, with reference to the accompanying schematic drawings in which corresponding reference symbols indicate corresponding parts, and in which.

DETAILED DESCRIPTION OF THE INVENTION

Figure 1:
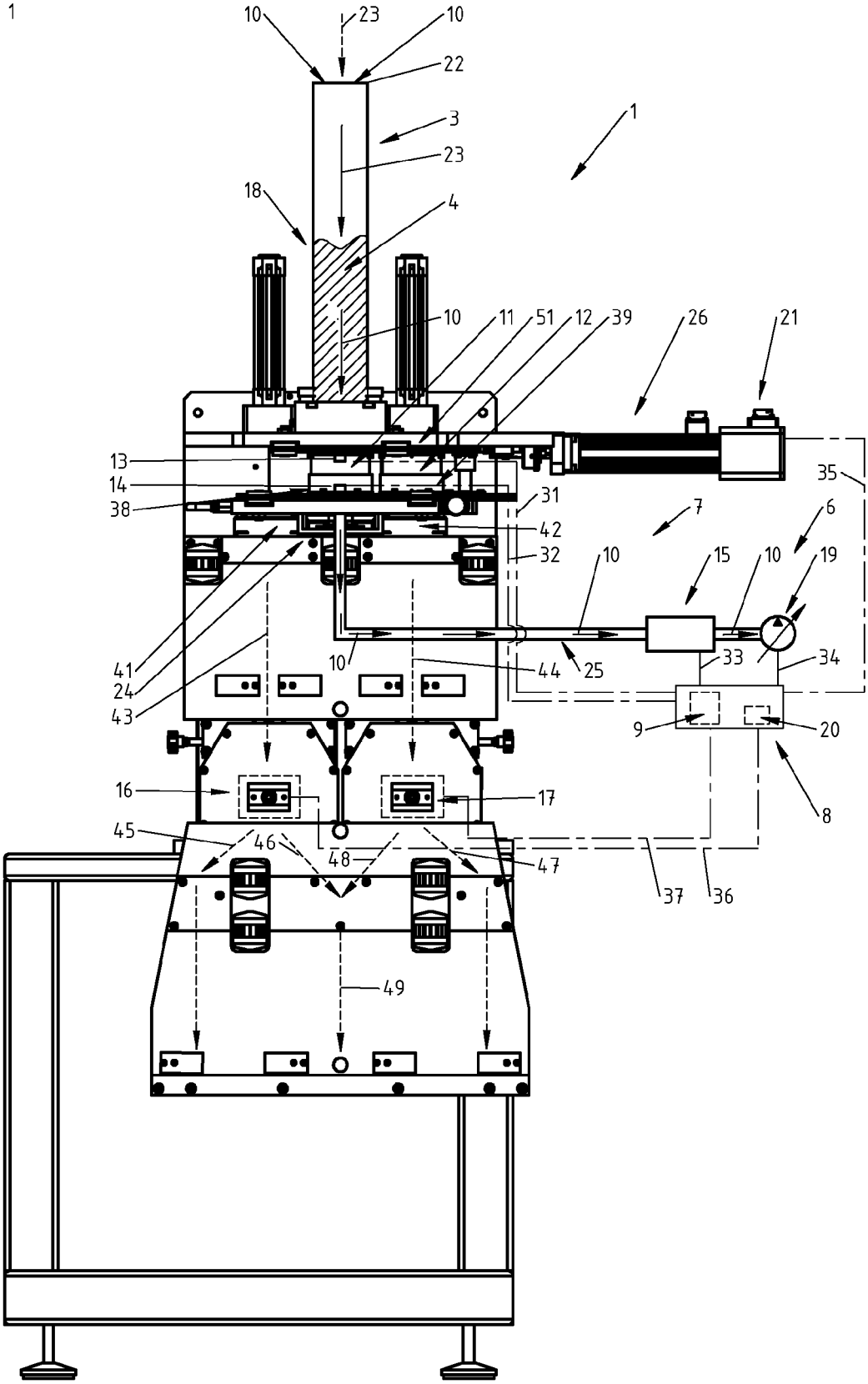
FIG. 1 schematically shows a front view of a first embodiment of a tobacco dosing system, FIG. 2 schematically shows an enlarged view in perspective of the dosing device of the tobacco dosing system of FIG. 1 in a first cup position, FIG. 3 schematically shows the dosing device of FIG. 2 in a second cup position, FIG. 4 schematically shows an enlarged view in perspective of the dosing cups of FIG. 1, FIG. 5 schematically shows the dosing cups of FIG. 4, FIG. 6 schematically shows a second embodiment of a tobacco dosing system.

FIG. 1 shows a first embodiment of a tobacco dosing system. The tobacco dosing system 1 for providing doses of tobacco 4 comprises a tobacco supply 3 constructed and arranged to supply tobacco 4. The tobacco supply 3 comprises a supply tube 18 constructed and arranged to hold tobacco 4. In use tobacco 4 is placed in the supply tube 18 by a tobacco supply system (not shown). The tobacco 4 enters the supply tube 18 via a tube opening 22. This is schematically indicated by arrow 23.

The tobacco dosing system 1 comprises a dosing device 5. The dosing device 5 comprises a first dosing cup 11 and a second dosing cup 12 for receiving the tobacco 4 which is to be dosed. Each of the dosing cups 11, 12 can be placed in a receiving position 38 for receiving tobacco 4 from the tobacco supply 3 and in a discharging position 39 for discharging a dose of tobacco 4. In the receiving position 38 the dosing cup 11, 12 is placed under the tobacco supply 3 and the tobacco 4 falls in the receiving cup space (see 58 of FIGS. 4 and 5). In the discharge position 39 the first dosing cup 11 is placed above a first discharge opening 41 and the second dosing cup 12 is placed above a second discharge opening 42, respectively.

The dosing cups 11, 12 are simultaneously movable by a cup driver 21. The first dosing cup 11 and second dosing cup 12 are interconnected and the cup driver 21 is constructed and arranged to move the dosing cups 11, 12 into a first cup position 51 in which the first dosing cup 11 is position in the receiving position 38 and the second dosing cup 12 is positioned in the discharging position 39 and into a second cup position 52 in which the first dosing cup 11 is position in the discharging position 39 and the second dosing cup 12 is positioned in the receiving position 38. By subsequently positioning the dosing cups 11, 12 in the first and second cup position 51 and 52, the first dosing cup 11 and the second dosing cup 12 by turns receive and discharge a dose of tobacco 4.

The tobacco 4 in the supply tube 18 is placed in the dosing cups 11, 12 by the gravity working on the tobacco 4 and by a gas flow 10 running through the supply tube 18 and the dosing cups 11, 12 positioned in the receiving position 38. In the embodiment shown, the gas flow 10 is an air flow. Other types of gas may be used. The gas flow 10 is produced by a gas flow device 6. The gas flow device 6 comprises a suction member 24 connected to a gas pump 19 via a fluid connection 25. In the embodiment shown, the fluid connection 25 comprises a gas tube. The gas pump 19 creates a under pressure in the fluid connection 25 and the suction member 24. Due to this, air is sucked into the supply tube 18 via the tube opening 22. This results in the air flow shown by the arrows 10. The gas flow 10 runs through the tobacco received by the dosing cups 11, 12 positioned in the receiving position 38.

The tobacco dosing system 1 comprises a controlling device 8 for controlling the operation of the tobacco dosing system 1. The controlling device 8 is operably connected to the cup driver 21 via a fifth communication connection 35 to control the operation of the dosing device 5. The controlling device 8 is operably connected to the gas pump 19 via a fourth communication connection 34 to control the operation of the gas flow device 6.

The tobacco dosing system 1 comprises a gas flow measuring device 7 constructed and arranged to measure a property of the gas flow 10. The controlling device 8 is operably connected to the gas flow measuring device 7 to control the operation of the tobacco dosing system 1 on basis of the measured property.

In one aspect the tobacco dosing system shown tends to be more accurate in discharging doses of a specific amount of tobacco.

In another aspect the tobacco dosing system shown tends to be able to discharge doses of tobacco in a faster way.

In another aspect the tobacco dosing system shown tends to hold the dosing cup 11, 12 for a shorter time period in the receiving position 38.

The controlling device 8 is provided with a memory 20 to store at least one operation value (for example an operation value entered in the memory by a user, or an operation value determined by the controlling device on basis of data of pervious operations of the tobacco dosing system). The controlling device 8 is constructed and arranged to store the measured properties in the memory 20.

The controlling device 8 is constructed and arranged to compare the measured property with the operation value. This way the controlling device 8 can for example instruct the dosing device 5 to remove the dosing cup 11, 12 located in the receiving position 38 out of said receiving position 38 and into the discharging position 39 once the measured property equals the operation value.

The controlling device 8 is provided with a calculator 9 to perform a calculation with the measured property. The controlling device 8 is constructed and arranged to store the calculated values in the memory 20. The controlling device 8 is constructed and arranged to compare the calculated value with the operation value. This way the controlling device 8 can for example instruct the dosing device 5 to remove the dosing cup 11, 12 located in the receiving position 38 out of said receiving position 38 and into the discharging position 39 once the calculated value equals the operation value. The calculated value may be R or R1 or R2 (as defined below).

It will be clear that the gas flow measuring device 7 may be constructed and arranged to measure multiple properties of the gas flow 10 and the controlling device 8 may be constructed and arranged to control the operation of the tobacco dosing system 1 on basis of the measured properties.

The gas flow measuring device 7 is provided with a first pressure sensor 13 and a second pressure sensor 14 to measure for each dose a pressure reduction ΔP in the gas flow 10. For each dose of tobacco 4 received by the dosing cups 11, 12, the first pressure sensor 13 measures a first pressure P1 and the second pressure sensor 14 measures a second pressure P2. The first pressure sensor 13 and the second pressure sensor 14 are operably connected to the controlling device 8 via a first communication connection 31 and a second communication connection 32, respectively. The calculator 9 performs for each dose the calculation: $\Delta P = P1 - P2$.

The first pressure P1 is measured in the air flow 10 at a first measuring location 71 and the second pressure P2 is measured at a second measuring location 72. Relative to the first measuring location 71, the second measuring location 72 is located downstream in the air flow 10. Tobacco received by the dosing cup 11, 12 is located between the first measuring location 71 and the second measuring location 72. When seen in the flow direction of the air flow 10, the first measuring location 71 may be located near the beginning of the dosing cup 11, 12. The second measuring location 72 may be located near the end of the dosing cup 11, 12.

The gas flow measuring device 7 is provided with a flow rate unit 15 to measure for each dose of tobacco 4 received by the dosing cups 11, 12 the volumetric flow rate Q of the gas flow 10. When seen in the flow direction of the air flow 10, the flow rate unit 15 may be located downstream of the second measuring location 72.

The calculator 9 is constructed and arranged to calculate for each dose a value R by performing a calculation on the measured properties. The calculator 9 is constructed and arranged to calculate for each dose the value R1 of the calculation: $R1 = \Delta P/Q$. The calculator 9 is constructed and arranged to calculate for each dose the value R2 of the calculation: $R2 = P2 * (\Delta P/Q)$.

The first dosing cup 11 discharges its dose of tobacco 4 via the first discharge opening 41. After that the dose follows a first tobacco route indicated by arrow 43. The tobacco 4 is received by a first weight measuring device 16 constructed and arranged to measure the weight of the dose. The first weight measuring device 16 is operably connected to the controlling device 8 via a sixth communication connection 36.

The first weight measuring device 16 measures the weight of the dose so that the controlling device 8 is able to determine whether the dose comprises the right amount of tobacco 4. If the dose comprises the right amount, the tobacco 4 is discharge along a first approved route indicated by arrow 45. If the dose does not comprise the right amount, the tobacco 4 is discharged along a first disapproved route indicated by arrow 46.

The second dosing cup 12 discharges its dose of tobacco 4 via the second discharge opening 42. After that the dose follows a second tobacco route indicated by arrow 44. The tobacco 4 is received by a second weight measuring device 17 constructed and arranged to measure the weight of the dose. The second weight measuring device 17 is operably connected to the controlling device 8 via a seventh communication connection 37.

The second weight measuring device 17 measures the weight of the dose so that the controlling device 8 is able to determine whether the dose comprises the right amount of tobacco 4. If the dose comprises the right amount, the tobacco 4 is discharge along a second approved route indicated by arrow 47. If the dose does not comprise the right amount, the tobacco 4 is discharged along a second disapproved route indicated by arrow 48.

The first disapproved route 46 and second disapproved route 48 come together to form a return route indicated by arrow 49. The return route 49 will deliver the tobacco 4 to the supply system (not shown) which will feed the tobacco 4 again to the tobacco supply 3.

The weight measuring devices 16, 17 together with the controlling device 8 function as a final check to approve or disapprove the doses of tobacco 4.

The weight measuring devices 16, 17 together with the controlling device 8 and the gas flow measuring device 7 can also be used to determine the operation value on basis of previous operations of the tobacco dosing system 1.

The controlling device 8 is constructed and arranged to relate for each dose the measured weight to the measured property on the gas flow 10 and to store said relation in the memory 20. The controlling device 8 is constructed and arranged to relate for each dose the measured weight to a calculated value and to store said relation in the memory. Said value may be R or R1 o R2. The controlling device 8 is able to do this for multiple discharges. The calculator 9 is constructed and arranged to perform a calculation with the relations stored in the memory to determine a value A. Said value A can be indicated as the operation value and can be stored in the memory 20. The value A may be a calculated average of the relations stored in the memory 20.

The controlling device 8 is constructed and arranged to adjust the gas flow 10. The controlling device 8 can control the amount of under pressure created by the gas pump 19.

Figure 2:
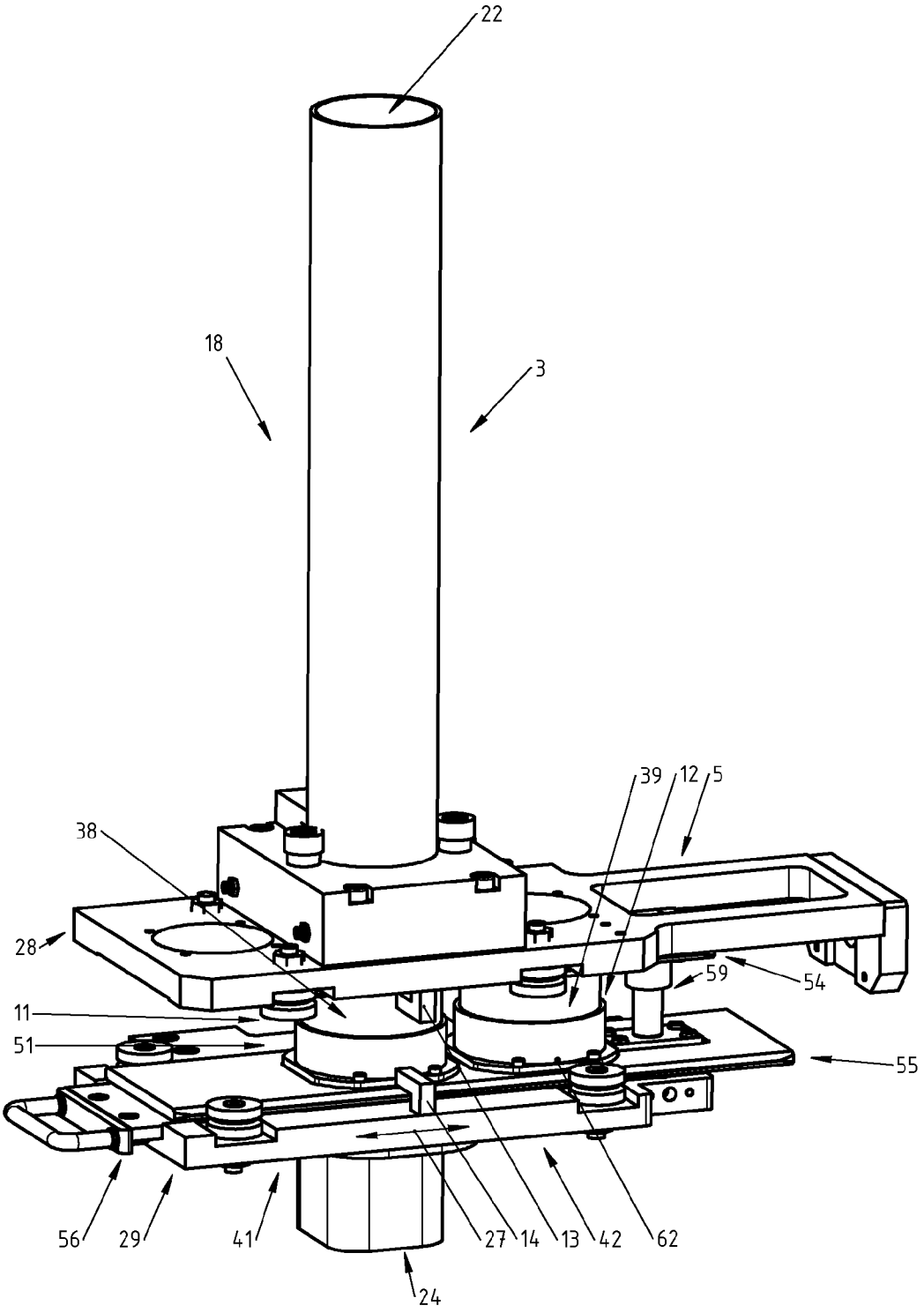

FIG. 2 shows an enlarged view in perspective of the dosing device 5 of the tobacco dosing system 1 of FIG. 1 in the first cup position 51. The first dosing cup 11 is located in the receiving position 38 and the second dosing cup 12 is located in the discharging position 39. The dosing cups 11, 12 are located between an upper first guide 28 and a lower second guide 29. The first and second guides 28, 29 are static and the dosing cups 11, 12 are movable between said guides 28, 29. The dosing cups 11, 12 are connected at their upper ends to a first guided member 54 and at their lower ends to a second guided member 55. Said guided members 54, 55 are slidable along the first and second guides 28, 29. This allows the dosing cups 11, 12 from the first cup position 51 into the second cup position 52, and vise versa. Said movement is indicated by arrow 27.

Each dosing cup 11, 12 comprises a first measuring opening (see 61 of FIGS. 4 and 5) and a second measuring opening 62. The first and second measuring openings 61, 62 are in fluid communication with the receiving cup space (see 58 of FIGS. 4 and 5). The first and second pressure sensor 13, 14 are connected to the first and second guide 28, 29, respectively. The pressure sensors 13, 14 are located such that the first pressure sensor 13 communicates with the first measuring opening 61 and the second pressure sensor 14 communicates with the second measuring opening 62 when the dosing cups 11, 12 are located in the receiving position 38.

A removable filter 56 is provided between the dosing cups 11, 12 in the receiving position 38 and the suction member 24 of the gas flow device 8. This allows the air flow 10 to run through the tobacco 4 received by the dosing cups 11, 12 located in the receiving position 38.

Figure 3:
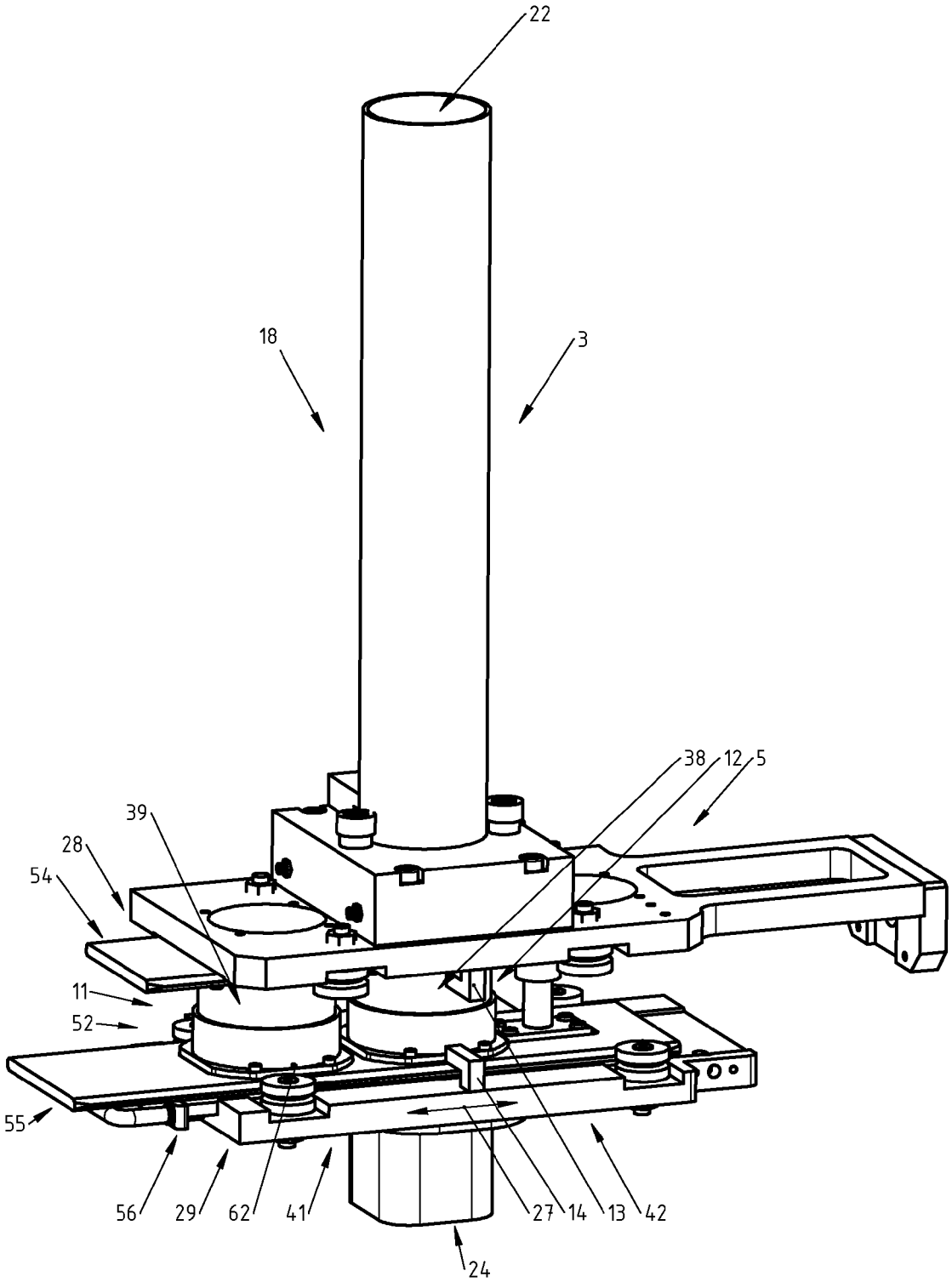

FIG. 3 shows an enlarged view in perspective of the dosing device 5 of the tobacco dosing system 1 of FIG. 1 in the second cup position 52. The first dosing cup 11 is located in the discharging position 39 and the second dosing cup 12 is located in the receiving position 38.

Figure 4:
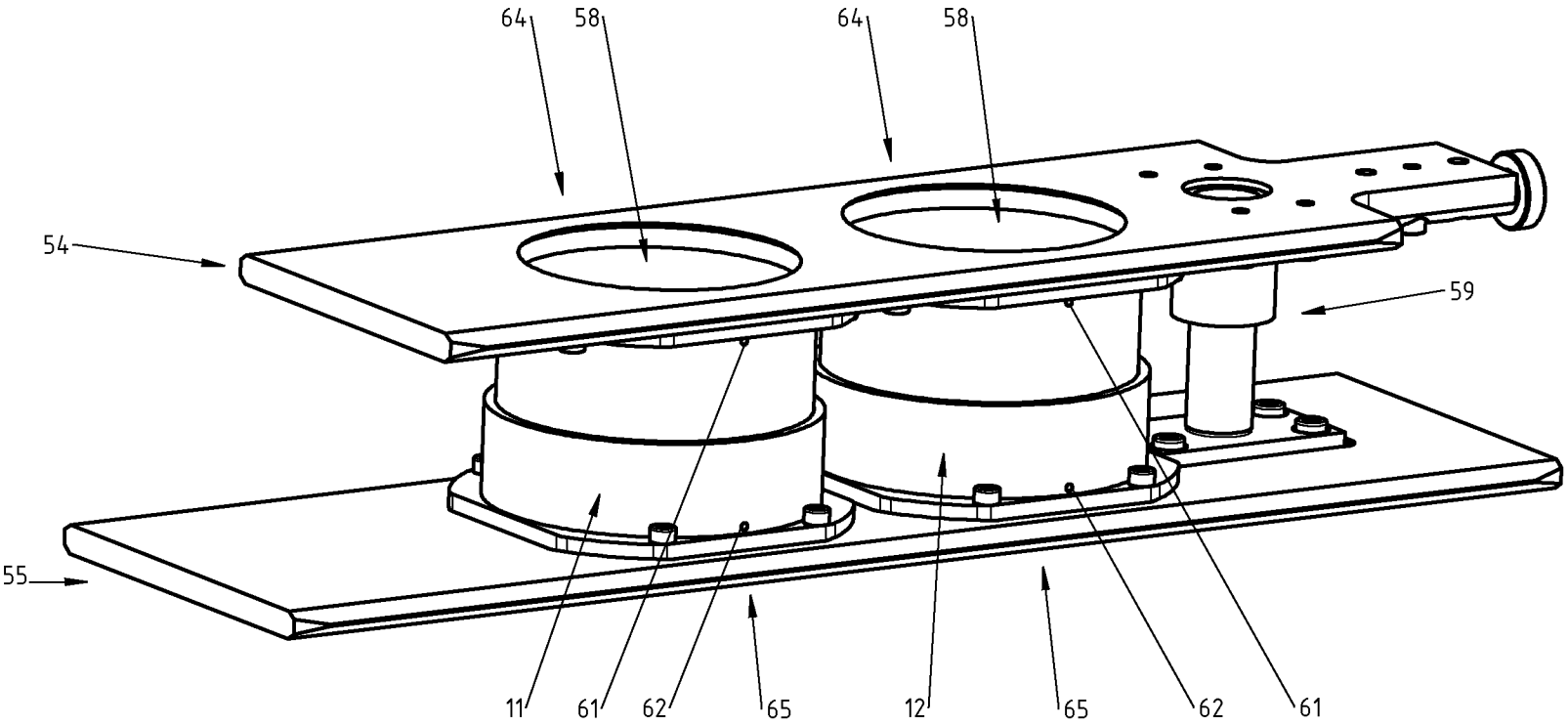

FIG. 4 shows an enlarged view in perspective of the dosing cups of FIG. 1. Each of the dosing cups 11, 12 comprises a receiving cup space 58 for receiving the tobacco 4 from the tobacco supply 3. The dosing cups 11, 12 are interconnected by the first and second guided member 54, 55. Said guided members 54, 55 are furthermore interconnected by an interconnecting member 59.

The first and second measure opening 61, 62 are in fluid communication with the receiving cup space 58. The locations where the first and second measure opening 61, 62 enter the receiving cup space 58 determine the location of the first and second measuring locations 71, 72, respectively.

In the embodiment shown, the first measuring location 71 is located below (downstream when seen in the direction of the gas flow 10) the upper end 64 of the dosing cups 11, 12. The first measuring location 71 may be located above (upstream when seen in the direction of the gas flow 10) the upper end 64 of the dosing cups 11, 12. The second measuring location 72 is located above (upstream when seen in the direction of the gas flow 10) the lower end 65 of the dosing cups 11, 12. The second measuring location 72 may be located below (downstream when seen in the direction of the gas flow 10) the lower end 65 of the dosing cups 11.

Figure 5:
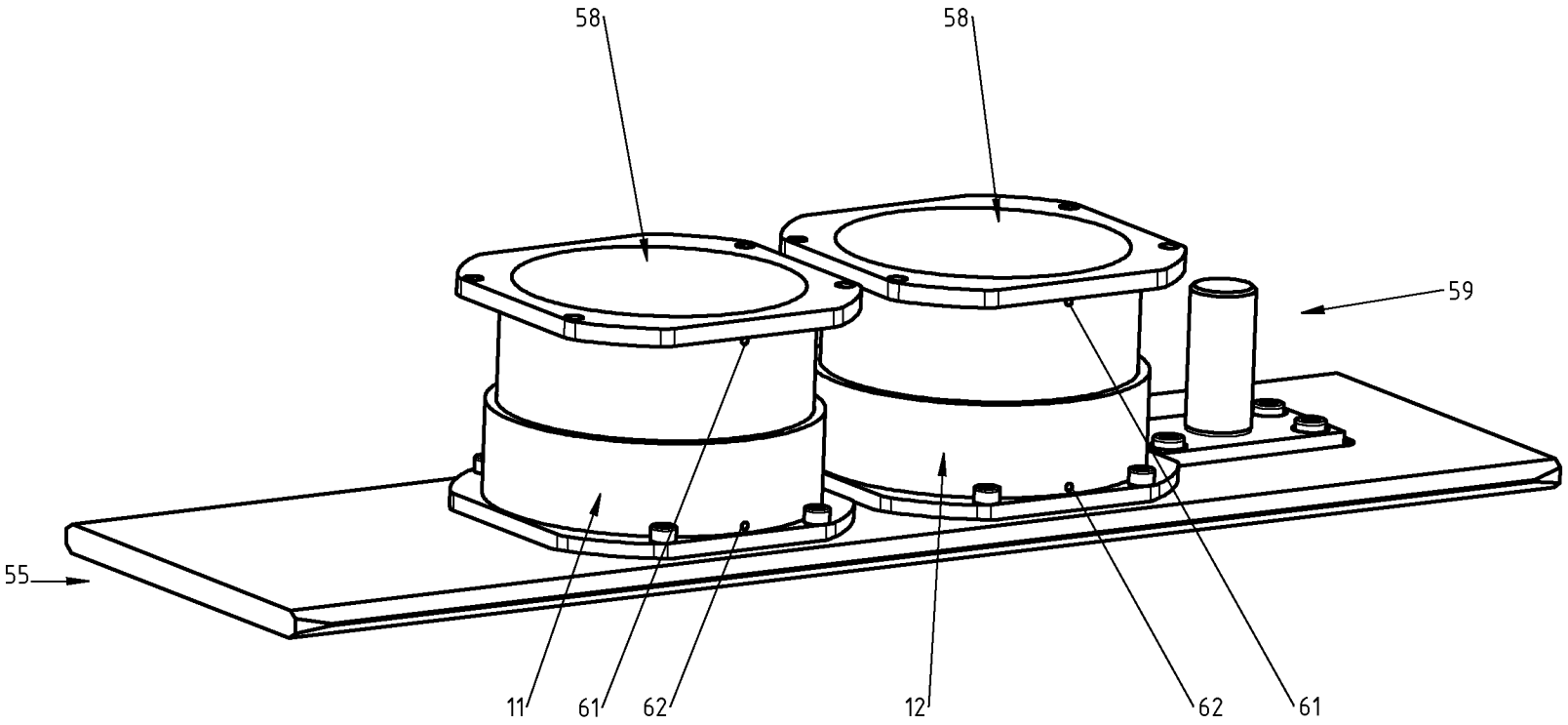

FIG. 5 shows the dosing cups 11, 12 of FIG. 4, wherein the first guided member 54 is removed.

Figure 6:
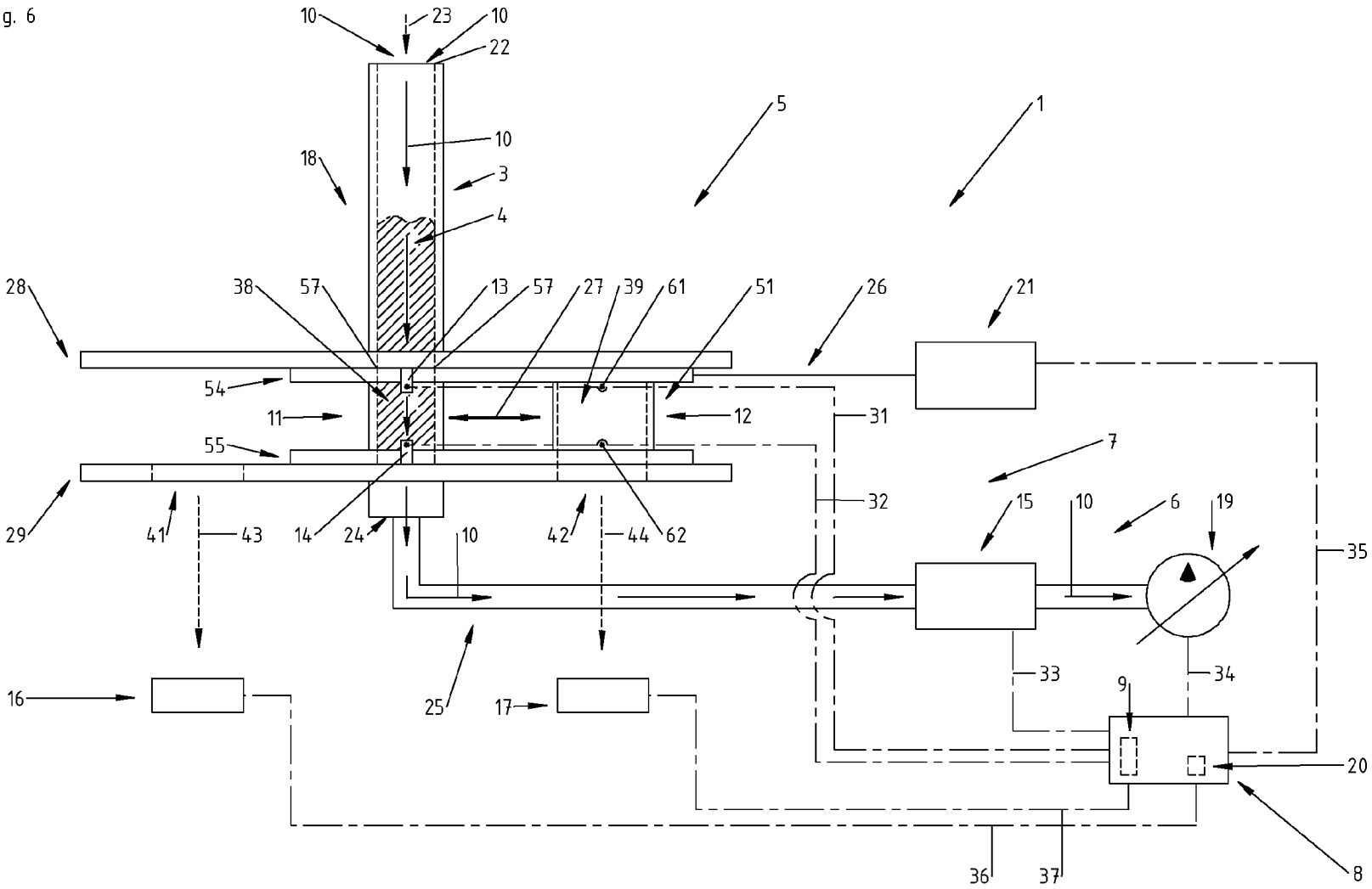

FIG. 6 shows a second embodiment of a tobacco dosing system 1. The cup driver 21 is connected to the first guided member 54 via a mechanical connector 26 allowing the cup driver 21 to move the dosing cups 11, 12 from the first cup position 51 into the second cup position 52, and vise versa. Said movement of the dosing cups 11, 12 is indicated by arrow 27.

The first guide 28 comprises a cutting edge 57 constructed and arranged to cut the tobacco 4 when the dosing cups 11, 12 moves from the receiving position 38 to the discharging position 39.

The following clauses are offered as a further description of embodiments of the tobacco dosing system according to the invention.

1. Tobacco dosing system for providing doses of tobacco, wherein the dosing system comprises;
   - a tobacco supply constructed and arranged to supply tobacco,
   - a dosing device comprising at least one dosing cup for receiving the tobacco to be dosed,
   - a gas flow device constructed and arranged to in use provide a gas flow through the tobacco received by the at least one dosing cup,
   - a gas flow measuring device constructed and arranged to measure a property of the gas flow, and
   - a controlling device operably connected to the dosing device and the gas flow measuring device to control the operation of the tobacco dosing system on basis of the measured property.

2. Tobacco dosing system according to clause 1, wherein the controlling device is provided with a calculator to perform a calculation with the measured property.

3. Tobacco dosing system according to clause 1 or 2, wherein the gas flow measuring device is provided with a pressure sensor to measure for each dose a pressure reduction $\Delta P$ in the gas flow.

4. Tobacco dosing system according to any of the preceding clauses, wherein the gas flow measuring device is provided with at least two pressure sensors to measure for each dose a first pressure P1 and a downstream second pressure P2 and the pressure reduction $\Delta P$ equals P1−P2.

5. Tobacco dosing system according to any of the preceding clauses, wherein the gas flow measuring device is provided with a flow rate unit to measure for each dose the volumetric flow rate Q of the gas flow.

6. Tobacco dosing system according to any of the clauses 2-5, wherein the calculator is constructed and arranged to calculate for each dose a value R by performing a calculation on the measured property.

7. Tobacco dosing system according to any of the clauses 2-6, wherein the calculator is constructed and arranged to calculate for each dose the value R1 of the calculation: $R1=\Delta P/Q$.

8. Tobacco dosing system according to any of the clauses 2-7, wherein the calculator is constructed and arranged to calculate for each dose the value R2 of the calculation: $R2=P2*(\Delta P/Q)$.

9. Tobacco dosing system according to any of the preceding clauses, wherein the controlling device is provided with a memory.

10. Tobacco dosing system according to clause 9, wherein the controlling device is constructed and arranged to allow the user to indicate an operation value and to store the operation value in the memory.

11. Tobacco dosing system according to clause 10, wherein the controlling device is constructed and arranged to compare the measured property with the operation value.

12. Tobacco dosing system according to clause 10 or 11, wherein the controlling device is constructed and arranged to compare the calculated value R with the operation value.

13. Tobacco dosing system according to any of the clauses 10-12, wherein the controlling device is constructed and arranged to compare the calculated value R1 with the operation value.

14. Tobacco dosing system according to any of the clauses 10-13, wherein the controlling device is constructed and arranged to compare the calculated value R2 with the operation value.

15. Tobacco dosing system according to any of the preceding clauses, wherein the dosing device is constructed and arranged to discharge the doses of tobacco and the dosing system comprises a weight measuring device constructed and arranged to measure the weight of each discharged dose of tobacco.

16. Tobacco dosing system according to clause 15, wherein the controlling device is constructed and arranged to relate for each dose the measured weight to the measured property on the gas flow and to store said relation in the memory.

17. Tobacco dosing system according to clause 15 or 16, wherein the controlling device is constructed and arranged to relate for each dose the measured weight to the calculated value R and to store said relation in the memory.

18. Tobacco dosing system according to any of the clauses 15-17, wherein the controlling device is constructed and arranged to relate for each dose the measured weight to the calculated value R1 and to store said relation in the memory.

19. Tobacco dosing system according to any of the clauses 15-18, wherein the controlling device is constructed and arranged to relate for each dose the measured weight of to the calculated value R2 and to store said relation in the memory.

20. Tobacco dosing system according to any of the clauses 16-19, wherein the calculator is constructed and arranged to perform a calculation with the relations stored in the memory to determine a value A and the controlling device is constructed and arranged to indicate the value A as the operation value and to store the value A in the memory.

21. Tobacco dosing system according to clause 20, wherein the value A is a calculated average of the relations stored in the memory.

22. Tobacco dosing system according to any of the preceding clauses, wherein the controlling device is constructed and arranged to adjust the gas flow.

23. Use of a tobacco dosing system according to any of the preceding clauses.

It will be apparent to those skilled in the art that various modifications can be made to the tobacco dosing systems disclosed without departing from the scope and spirit thereof.

The invention claimed is:

1. A tobacco dosing system for providing doses of tobacco, wherein the dosing system comprises:

a tobacco supply constructed and arranged to supply tobacco;

a dosing device comprising at least one dosing cup for receiving the tobacco to be dosed, which dosing cup is configured to receive the tobacco in a receiving space via an upper end of the dosing cup and to discharge the received tobacco via a lower end of the dosing cup, and wherein the dosing cup is movable between a receiving position in which the dosing cup is located under the tobacco supply to be filled with tobacco and a discharge position in which the dosing cup is located above a discharge opening to discharge the received tobacco;

a gas flow device constructed and arranged to in use provide a gas flow through the tobacco received in the receiving space of the at least one dosing cup, which gas flow enters the receiving space via the upper end and leaves the receiving space via the lower end, so that the gas flow runs through the complete dose of tobacco;

a gas flow measuring device constructed and arranged to measure a property of the gas flow in the dosing cup; and a controlling device operably connected to the dosing device and the gas flow measuring device to control the operation of the tobacco dosing system on basis of the measured property.

2. The tobacco dosing system according to claim 1, wherein the controlling device is provided with a calculator to perform a calculation with the measured property.

3. The tobacco dosing system according to claim 1, wherein the gas flow measuring device is provided with a pressure sensor to measure for each dose a pressure reduction $\Delta P$ in the gas flow or wherein the gas flow measuring device is provided with at least two pressure sensors to measure for each dose a first pressure P1 and a downstream second pressure P2 and the pressure reduction $\Delta P$ equals P1−P2.

4. The tobacco dosing system according to claim 1, wherein the gas flow measuring device is provided with a flow rate unit to measure for each dose the volumetric flow rate Q of the gas flow.

5. The tobacco dosing system according to claim 2, wherein the calculator is constructed and arranged to calculate for each dose a value R by performing a calculation on the measured property.

6. The tobacco dosing system according to claim 2, wherein the calculator is constructed and arranged to calculate for each dose a value R1 of the calculation: $R1=\Delta P/Q$, where Q is a volumetric flow rate of the gas flow and $\Delta P$ is a pressure reduction in the gas flow.

7. The tobacco dosing system according to claim 2, wherein the gas flow measuring device is provided with at least two pressure sensors to measure for each dose a first pressure P1 and a downstream second pressure P2 and the pressure reduction $\Delta P$ equals P1−P2; and wherein the calculator is constructed and arranged to calculate for each dose a value R2 of the calculation: $R2=P2*(\Delta P/Q)$, where Q is a volumetric flow rate of the gas flow and $\Delta P$ is a pressure reduction in the gas flow.

8. The tobacco dosing system according to claim 2, wherein the controlling device is provided with a memory.

9. The tobacco dosing system according to claim 8, wherein the controlling device is constructed and arranged to allow the user to indicate an operation value and to store the operation value in the memory.

10. The tobacco dosing system according to claim 9, wherein the controlling device is constructed and arranged to compare the measured property with the operation value.

11. The tobacco dosing system according to claim 5, wherein the controlling device is constructed and arranged to compare the calculated value R with the operation value.

12. The tobacco dosing system according to claim 6, wherein the controlling device is constructed and arranged to compare the calculated value R1 with the operation value.

13. The tobacco dosing system according to claim 7, wherein the controlling device is constructed and arranged to compare the calculated value R2 with the operation value.

14. The tobacco dosing system according to claim 1, wherein the dosing device is constructed and arranged to discharge the doses of tobacco and the dosing system comprises a weight measuring device constructed and arranged to measure the weight of each discharged dose of tobacco.

15. The tobacco dosing system according to claim 8, wherein the dosing device is constructed and arranged to discharge the doses of tobacco and the dosing system comprises a weight measuring device constructed and arranged to measure the weight of each discharged dose of tobacco; and wherein the controlling device is constructed and arranged to relate for each dose the measured weight to the measured property on the gas flow and to store said relation in the memory.

16. The tobacco dosing system according to claim 8, wherein the dosing device is constructed and arranged to discharge the doses of tobacco and the dosing s stem comprises a weight measuring device constructed and arranged to measure the weight of each discharged dose of tobacco;

wherein the calculator is constructed and arranged to calculate for each dose a value R by performing a calculation on the measured property; and wherein the controlling device is constructed and arranged to relate for each dose the measured weight to the calculated value R and to store said relation in the memory.

17. The tobacco dosing system according to claim 8, wherein the dosing device is constructed and arranged to discharge the doses of tobacco and the dosing system comprises a weight measuring device constructed and arranged to measure the weight of each discharged dose of tobacco;

wherein the calculator is constructed and arranged to calculate for each dose a value R1 of the calculation: R1=ΔP/Q, where Q is a volumetric flow rate of the gas flow and ΔP is a pressure reduction in the gas flow; and wherein the controlling device is constructed and arranged to relate for each dose the measured weight to the calculated value R1 and to store said relation in the memory.

18. The tobacco dosing system according to claim 8, wherein the dosing device is constructed and arranged to discharge the doses of tobacco and the dosing system comprises a weight measuring device constructed and arranged to measure the weight of each discharged dose of tobacco;

wherein the gas flow measuring device is provided with at least two pressure sensors to measure for each dose a first pressure P1 and a downstream second pressure P2 and the pressure reduction ΔP equals P1−P2;

wherein the calculator is constructed and arranged to calculate for each dose a value R2 of the calculation: R2=P2*(ΔP/Q), where Q is a volumetric flow rate of the gas flow and ΔP is a pressure reduction in the gas flow; and wherein the controlling device is constructed and arranged to relate for each dose the measured weight of to the calculated value R2 and to store said relation in the memory.

19. The tobacco dosing system according to claim 15, wherein the calculator is constructed and arranged to perform a calculation with the relations stored in the memory to determine a value A and the controlling device is constructed and arranged to indicate the value A as an operation value and to store the value A in the memory, and wherein the value A is a calculated average of the relations stored in the memory.

20. The tobacco dosing system according to claim 1, wherein the controlling device is constructed and arranged to adjust the gas flow.

* * * * *